US005611755A

United States Patent [19]

Blackmore

[11] Patent Number: 5,611,755

[45] Date of Patent: Mar. 18, 1997

[54] ISOMETRIC HAND EXERCISING SYSTEM

[75] Inventor: John M. Blackmore, Redwood City, Calif.

[73] Assignee: MedDev Corporation, Palo Alto, Calif.

[21] Appl. No.: 456,857

[22] Filed: Jun. 1, 1995

[51] Int. Cl.[6] ..... A63B 23/16

[52] U.S. Cl. ..... 482/49; 482/126; 482/44

[58] Field of Search ..... 482/44, 49, 121, 482/122, 126

[56] References Cited

U.S. PATENT DOCUMENTS

| | | | |
|---|---|---|---|
| 1,495,278 | 5/1924 | Titus | 482/49 |
| 2,621,652 | 12/1952 | Ehrhardt . | |
| 3,570,849 | 3/1971 | Ratchford . | |
| 4,226,412 | 10/1980 | Panepinto . | |
| 4,553,746 | 11/1985 | Lee . | |
| 5,125,878 | 6/1992 | Wingate et al. . | |

*Primary Examiner*—Lynne A. Reichard
*Attorney, Agent, or Firm*—Flehr, Hohbach, Test, Albritton & Herbert

[57] ABSTRACT

An exercising apparatus and method for exercising the hands and forearms. The apparatus includes an outer frame having spaced first and second outer handles, and an inner frame coupled to the outer frame for reciprocal movement between the outer handles and having first and second inner handles. The first outer handle and first inner handle define a first gripping member, and the second outer handle and second inner handle define a second gripping member. The gripping members are each engageable by a hand for selectively moving the inner handle toward the outer handle and resisting movement of the inner handle away from the outer handle. The method includes the steps of providing an exerciser, grasping the first outer handle and the first inner handle with a first hand and the second outer handle and the second inner handle with a second hand, and moving the inner frame between the outer handles.

13 Claims, 3 Drawing Sheets

ISOMETRIC HAND EXERCISING SYSTEM

BRIEF DESCRIPTION OF THE INVENTION

The present invention relates in general to a hand exercising system and, more particularly, to an apparatus and method for strengthening the hands and forearms.

BACKGROUND OF THE INVENTION

Various exercise devices have been used to increase the strength and range of motion of the muscles and tendons in the hands and forearms. One type of device is used to simultaneously exercise both hands. Such devices typically include a pair of handles coupled together by an elastic tensioning member, with the user repeatedly pulling the handles apart and then allowing the handles move back together. This type of exercising device relies upon the individual to utilize the appropriate muscles when operating the device. However, the individual may have a tendency to use other muscles such as those in the upper arms, back and chest area to provide assistance during the exercises, particularly when the individual begins to tire. If other muscles are used, the exercises will work the stronger muscles while having a minimal effect on the target muscles and tendons of the hands and forearms. When the exercises are used for rehabilitation purposes, maximizing the effect of the exercises on the muscles in the hands and forearms is of particular importance. An exercise apparatus which isolates the muscles in the hand and forearm from the assistance of other muscle groups is desirable.

For an exercise device to be effective, the device must apply the appropriate amount of resistance to the muscles during the exercises. The two-hand exercise devices typically apply a fixed amount of resistance, requiting the individual to utilize a different device if a greater or lesser amount of resistance is required. An exercising apparatus in which the individual may vary the amount of resistance applied during the exercises is desirable.

Other exercise devices may be used to exercise one hand by grasping a pair of spaced handles in one hand and repeatedly closing the hand to move the handles together. U.S. Pat. Nos. 4,226,412 and 4,553,746 disclose examples of one-hand exercise devices in which the resistance is provided by springs. The resistance provided with the device shown in U.S. Pat. No. 4,553,746 may be varied somewhat by adjusting the amount the springs are compressed. However, the disclosed devices must be disassembled and the springs replaced if the individual wishes to significantly change the resistance. U.S. Pat. Nos. 3,570,849 and 5,125,878 disclose exercise devices for one hand in which the resistance may be adjusted by easily adding or removing tensioning members. With the device shown in U.S. Pat. No. 5,125,878, the distance initially separating the spaced handles may also be adjusted.

An exercise device for one or both hands in which the proper resistance may be provided for each application is desirable. Similarly, an exercise device in which the resistance may be adjusted without altering the device is desirable. An exercise device in which the resistance may be varied during each exercise stroke is also desirable.

OBJECTS AND SUMMARY OF THE INVENTION

It is a primary object of this invention to provide an exercising apparatus for exercising the muscles and tendons of the hands and forearms.

It is a further object of the invention to provide an exercising apparatus which exercises the muscles in the hand and forearm without using the muscles in the upper arms, back or chest area.

It is another object of the invention to provide an exercising apparatus in which the individual may vary the amount of resistance provided by the apparatus.

It is yet another object of the invention to provide an exercising apparatus in which the resistance may be adjusted without altering the apparatus.

It is still another object of the invention to provide an exercising apparatus in which the resistance may be varied during each exercise stroke.

It is another object of the invention to provide an exercising apparatus which may be used to exercise either one or both hands and forearms.

It is a more general object of the invention to provide an exercising apparatus which is easy and convenient to use, comfortable to the hands, and which may be efficiently and economically manufactured.

In summary, this invention provides an exercising apparatus and method which is particularly suitable for increasing the strength and range of motion of the muscles and tendons in the hands and forearms. The exercising apparatus includes an outer frame having spaced outer handles and an inner frame having inner handles. The inner frame is slidably mounted to the outer frame for movement between the outer handles, with movement in each direction moving one of the inner handles toward one of the outer handles. A first gripping member is defined by one of the outer handles and the associate inner handle, while the other handles define a second gripping member. The gripping members are each engageable by a hand for sliding the inner frame back and forth along the outer frame. The inner frame is moved in either direction by moving one inner handle toward the associated outer handle while resisting movement of the other inner handle away from the other outer handle.

The method of exercising the hands and muscles includes the steps of providing an exerciser having an outer frame having spaced outer handles and an inner frame coupled to the outer frame for reciprocal movement of the inner frame relative to the outer frame between the outer handles. The inner frame has a pair of inner handles. The method further includes the steps of grasping an outer handle and inner handle with a first hand while grasping the other outer handle and inner handle with a second hand. The inner frame is moved between the outer handles by manipulating the hands so that the first hand moves the grasped inner handle toward the outer handle while the second hand resists movement of the grasped inner handle away from the outer handle. The direction of the inner frame is reversed by manipulating the hands so that the second hand moves the grasped inner handle toward the outer handle while the first hand resists movement of the grasped inner handle away from the outer handle.

Additional objects and features of the invention will be more readily apparent from the following detailed description and appended claims when taken in conjunction with the drawings.

DETAILED DESCRIPTION OF THE INVENTION

Figure 1:
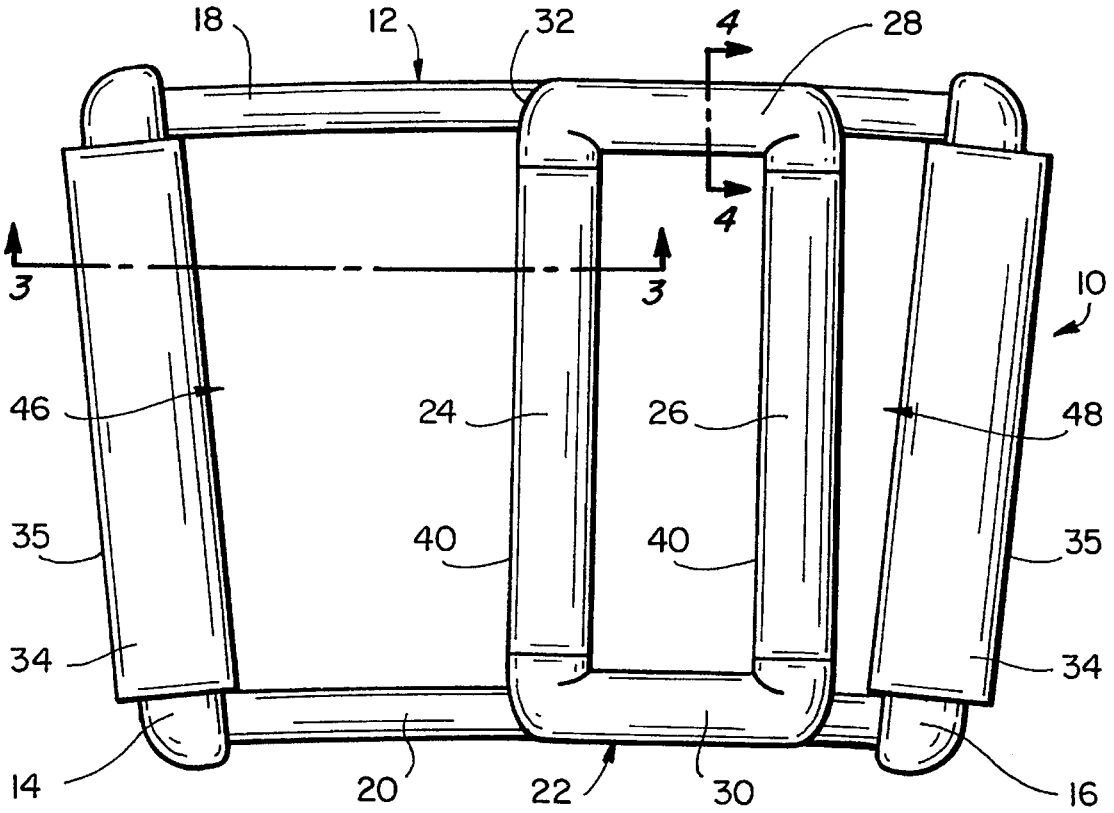
FIG. 1 is a front plan view of an exercising apparatus in accordance with the invention, shown with the inner frame in a first position.
Figure 3:
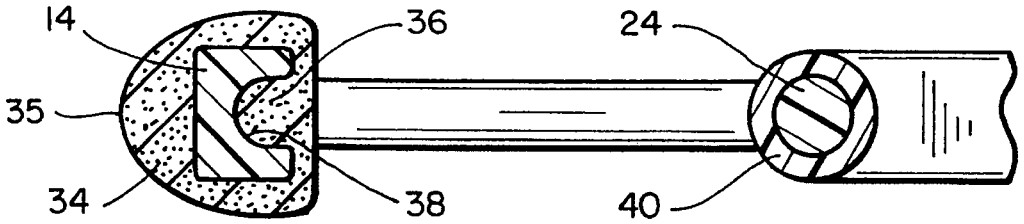
FIG. 3 is a cross sectional view taken substantially along line 3—3 of FIG. 1.

Reference will now be made in detail to the preferred embodiment of the invention, which is illustrated in the accompanying figures. Turning now to the drawings, wherein like components are designated by like reference numerals throughout the various figures, attention is directed to FIGS. 1–4.

FIGS. 1–4 show an exercising apparatus particularly suitable for exercising the hands and forearms to increase the strength, flexibility and range of motion of the muscles and tendons. The exercising apparatus 10 generally includes an outer frame 12 having a pair of spaced outer handles 14 and 16. Two elongate rail members 18 and 20 extend between and are mounted to the outer handles 14 and 16. In the present embodiment, the uppermost rail member 18 is approximately twenty to twenty-five percent longer than the lower rail 20 so that the hands may be comfortably held in the proper position relative to the upper body during the exercise session. However, it will be understood that in other embodiments of the invention the difference in size between the rail members 18 and 20 may be increased or decreased or the members 18 and 20 may have the same length if desired.

An inner frame 22 is coupled to the outer frame 12 for reciprocating movement between outer handles 14 and 16. The inner frame 22 includes a pair of inner handles 24 and 26 each associated with one of the outer handles 14 and 16. A pair of connecting members 28 and 30 extend between and are mounted to inner handles 24 and 26. As is shown particularly in FIG. 3, connecting members 28 and 30 are of substantially the same size. If desired, the upper connecting member 28 may be longer than the lower connecting member 30 as with the rails 18 and 20 of the outer frame. The inner handles 22 and 24 and the connecting members 28 and 30 may be formed as a monolithic structure as in the present embodiment, or the handles and connecting members may be formed separately and secured together using suitable securement means.

Figure 2:
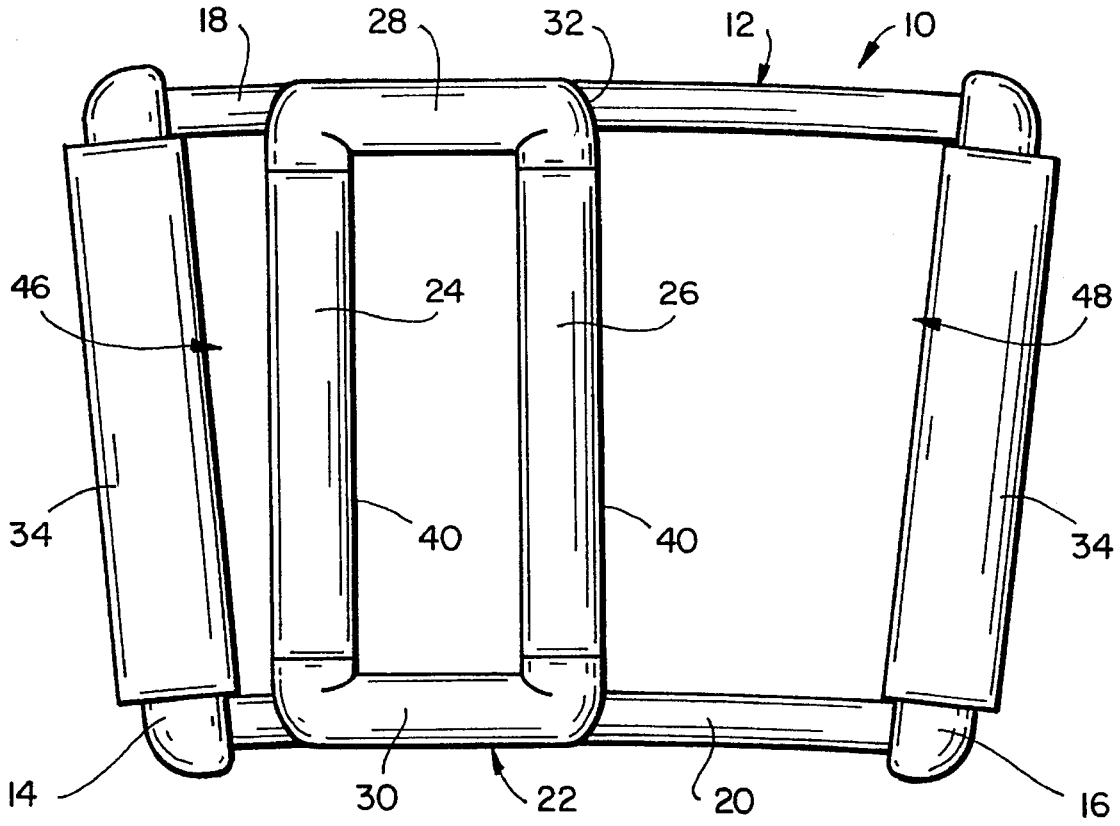
FIG. 2 is a front plan view of the exercising apparatus of FIG. 1, shown with the inner frame in a second position.
Figure 4:
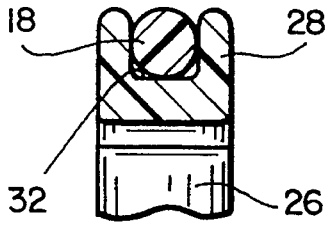
FIG. 4 is a cross sectional view taken substantially along line 4—4 of FIG. 1.

As is demonstrated by FIGS. 1 and 2, the inner frame 22 slides along the rail members 18 and 20 between the outer handles 14 and 16. Connecting members 28 and 30 are each formed with a longitudinally extending channel 32, shown in FIG. 4, which is shaped to receive the rail member of the outer frame and permit sliding movement of the connecting members relative to the rails 18 and 20. The spacing between the rail members 18 and 20 and the depth of the channels 32 are selected so that the inner frame 22 is securely held within the outer frame 12 during operation of the device. The side walls of the channel 32 is subject to considerable variation provided any lateral displacement of the rail from the channel is minimized. Although not shown, the channel 32 may be replaced by an enclosed passageway extending through the connecting members 28 and 30 for additional stability. Moreover, other means may be employed to couple the inner frame to the outer frame.

Outer handles 14 and 16 preferably include a protective cushion sleeve 34 to protect the hand from soreness and discomfort. As is shown particularly in FIG. 4, the outer portion 35 of the sleeve 34 has a greater thickness so that the cushion sleeve conforms to the shape of the hand. The sleeve 34 has an inner protruding ridge 36 shaped to mate with a groove 38 formed in the outer handle 12 to prevent rotation of the sleeve relative to the handle. The inner surface of the sleeve is substantially planar to minimize any interference with the movement of the inner frame 22. In other modifications of the invention, the cushion sleeve may have other shapes. Alternatively, the cushion sleeves may be omitted and the outer handles 14 and 16 shaped to be comfortably held in the hand.

In this embodiment, inner handles 24 and 26 are provided with a rotatable sleeve 40. The rotatable sleeve 40 allows the fingers to bend naturally when the inner frame is moved relative to the outer frame. Instead of the rotatable sleeve 40, a cushion sleeve may be mounted on the inner handles for additional comfort and protection against blistering and the like. If desired, the cushion sleeve may be rotatably mounted to the inner handle to protect the fingers while preserving the natural bending movements of the hands.

During use, the individual grips the inner and outer handles with both hands. The left outer handle 14 and left inner handle 24 define a first gripping member generally designated 46, while the right outer handle 16 and right inner handle 26 define a second gripping member generally designated 48. During operation of the exercising apparatus 10, the individual grasps the first gripping member 46 in one hand and the second gripping member 48 in the other hand. The inner frame 22 may be moved to the left by manipulating the gripping member 46 to move the inner handle 24 toward the outer handle 14 while manipulating the gripping member 48 to resist movement of the inner handle 26 away from the outer handle 16. Similarly, the inner frame may be moved to the right by manipulating the gripping members to move the inner handle 26 toward the outer handle 16 while resisting movement of the inner handle 24 away from the outer handle 14. In other words, the gripping members 46 and 48 are manipulated so that one hand provides the resistance for exercising the other hand.

With exercising apparatus 10 of the present invention, the individual controls the amount of resistance applied during each exercise stroke. During operation of the apparatus, the individual may closely monitor the hand and forearm and immediately make any adjustments in the amount of resistance required allowing the individual to easily apply the exact amount of resistance required. If necessary, the resistance may be varied during the exercise stroke by controlling the movement of the inner handle away from the outer handle. As muscle and tendon strength increases, the user may apply greater resistance by substantially restraining the movement of the inner handle. Restraining movement of the inner handle away from the outer handle also offers the advantage of exercising the hand and forearm while manipulating the gripping member.

The individual's ability to control the amount of resistance is of particular advantage when the apparatus is used in the rehabilitation of an injured or damaged hand or forearm where flexibility and strength of the various muscles and tendons may be significantly impaired. The immediate feedback maximizes the efficiency of the exercise session by ensuring the optimum resistance is continuously applied during the entire session. Moreover, as the patient notices improvements in muscle condition he will be encouraged to continue or even increase the exercise activity, significantly improving the efficiency of the rehabilitative treatment.

Figure 5:
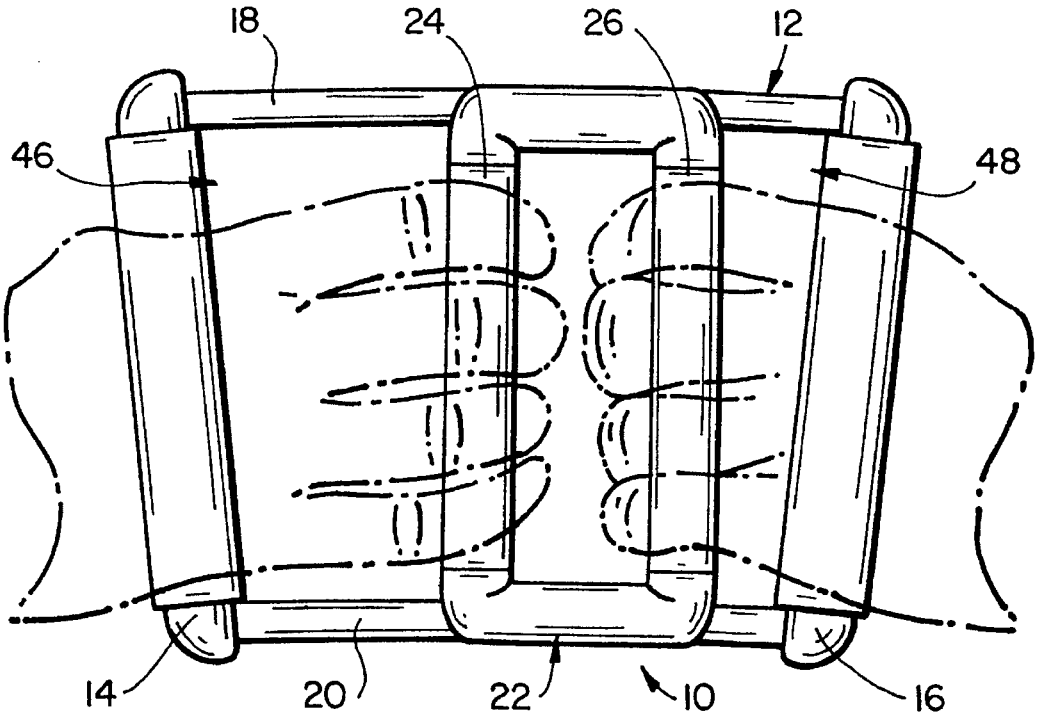
FIG. 5 is a front plan view of the exercising apparatus of FIG. 1, shown engaged by hands in a first exercising position.

The exercising apparatus 10 of the present invention may be used for performing exercises designed for one or both hands. The technique for simultaneously exercising both hands and forearms is described in relation to FIG. 5. The hands grasp the gripping members 46 and 48 with the fingers positioned on the inner handles and the thumb engaging the outer handles. In FIG. 5, all four fingers are positioned on each inner handle. However, any number of fingers may engage each handle depending upon the needs of a particular individual. It is not necessary that the same number of fingers on each hand are used; for example, one hand may have only one finger positioned on the inner handle while the other hand has three fingers on the handle. The outer frame 12 is preferably orientated with the thumbs pointing in the general direction of the long upper rail 18.

The inner frame 22 is moved back and forth relative to the outer frame 12 as follows. The fingers of the left hand manipulate the gripping member 46 to pull the inner handle 24 toward the outer handle 14. Simultaneously, the right hand engages the gripping member 48 to create the desired level of resistance by restraining movement of the inner handle 26 away from the outer handle 16. Depending upon the present condition of the hands and/or forearms, the inner frame may be moved completely to the left or to a position spaced inwardly from the outer handle 14. The process is then reversed with the right hand pulling the inner frame 22 to the right and the left hand creating the desired level of resistance. The exercise is repeated for the desired number of repetitions.

Figure 6:
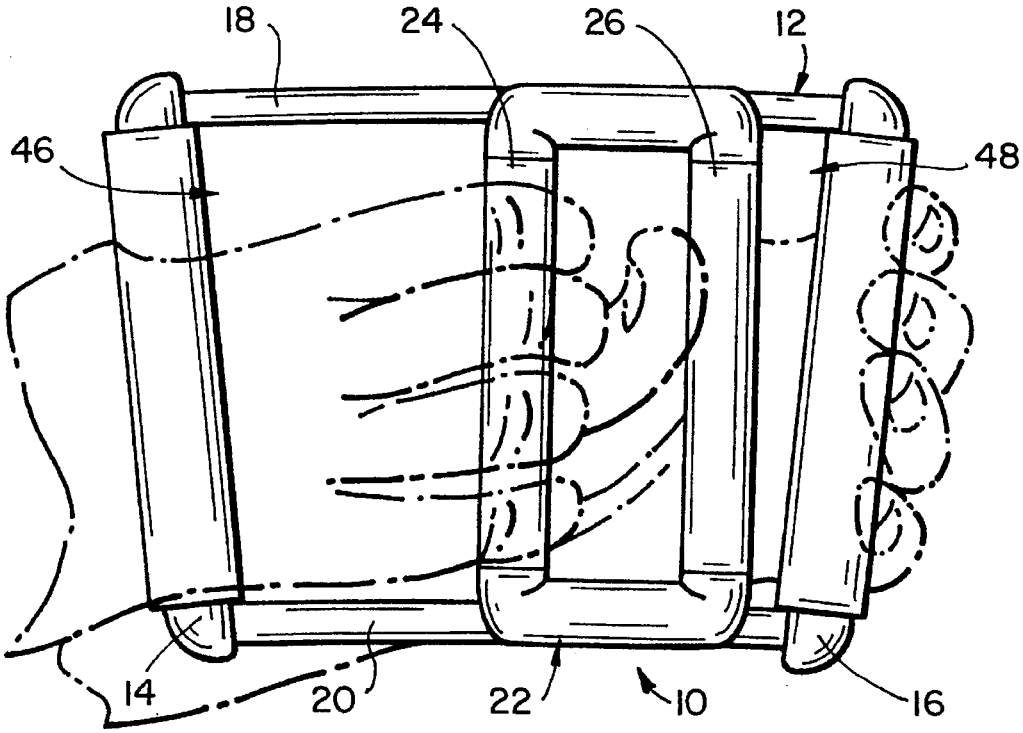
FIG. 6 is a front plan view of the exercising apparatus of FIG. 1, shown engaged by hands in a second exercising position.

The exercising apparatus 10 may also be used to exercise one hand at a time by adjusting the position of the hands and forearms. Often, it is desirable to exercise one hand independently of the other, particularly where the condition of one hand must be improved before the dual-hand exercising technique described in relation to FIG. 5 will be effective. The apparatus 10 is positioned in an orientation generally perpendicular to the upper body. FIG. 6 shows a suitable hand position for exercising the right hand while providing resistance with the left hand. One or more fingers of the left hand are positioned on the outer handle 16 while the left thumb engages the inner handle 26. The right hand is positioned with one or more fingers positioned on the inner handle 24 and the thumb engaging the outer handle 14. The thumbs preferably point in the general direction of the long rail member 18 of the outer frame 12.

The apparatus 10 is operated to exercise the left hand as follows. The right hand manipulates the gripping member 46 to pull the inner frame 22 inwardly toward the body and move the inner handle 24 toward the outer handle 14 while the left hand restrains movement of the inner handle 26 away from the outer handle 16, controlling the resistance. After the inward stroke has been completely, the left thumb moves the inner handle 26 toward the outer handle 16 to return the inner frame 22 to the starting position. During the return stroke, the right hand may be relaxed or, if desired, the individual may resist movement of the inner handle 24 away from the outer handle 14. The left hand may be exercised in a similar manner by simply reversing the position of the hands on the exercising apparatus 10.

The relative positions of the outer handles 14 and 16 and the inner handles 24 and 26 ensure that the hands are positioned so that only the muscles and tendons in the hands and forearms are used to slide the inner frame along the outer frame. Thus, the exercising apparatus 10 of the present invention prevents the individual from using the muscles in the upper arms, back and chest area to help the hand and forearm during the exercising session. Isolating the hands and forearms during the exercise increases the efficiency of the exercise program and significantly improves the rehabilitation process.

What is claimed is:

1. An exercising apparatus comprising:

an outer frame having spaced apart first and second outer handles, an inner frame coupled to said outer frame for reciprocating movement of said inner frame between said outer handles, said inner frame having first and second inner handles retained in a fixed spaced-apart configuration during the reciprocating movement of said inner frame, said inner handles each being positioned opposite one of said outer handles so that said first inner handle is moved toward said first outer handle and said second inner handle is moved away from said second outer handle when said inner frame is moved in a first direction, and said second inner handle is moved toward said second outer handle and said first inner handle is moved away from said first outer handle when said inner frame is moved in a second direction, said first outer handle and said first inner handle defining a first gripping member and said second outer handle and said second inner handle defining a second gripping member, said gripping members each being engageable by a hand for moving said inner frame relative to said outer frame with one hand applying force to one of said gripping members to move said inner handle of said one of said gripping members toward said outer handle of said one of said gripping members while the other hand applies force to the other of said gripping members to resist movement of said inner handle of said other of said gripping members away from said outer handle of said other of said gripping members, said inner frame being movable relative to said outer frame by engaging each of said gripping members with a hand to move said inner frame relative to said outer frame with one hand while resisting the movement of said inner frame relative to said outer frame with the other hand.

2. The exercising apparatus of claim 1 in which said outer frame includes a pair of spaced elongated members extending between said outer handles, said inner frame being carried by said elongated members for movement between said outer handles.

3. The exercising apparatus of claim 2 in which one of said elongated members is twenty to twenty-five percent longer than the other of said elongated members such that when said outer handles are each positioned in a hand, said outer frame retains the hands and arms in a proper exercise position during use of said apparatus.

4. The exercising apparatus of claim 2 in which said inner frame includes a pair of spaced rigid connecting members joining said inner handles together, each of said connecting members being shaped to receive one of said elongated members.

5. The exercising apparatus of claim 4 in which said connecting members have a channel formed therein, said channel being shaped to slidably receive said elongated member.

6. The exercising apparatus of claim 1 in which at least one of said inner handles is rotatable relative to said inner frame.

7. The exercising apparatus of claim 6 in which said first inner handle and said second inner handle are rotatable relative to said frame.

8. The exercising apparatus of claim 1 in which at least one of said outer handles includes a cushioning material for protecting said hand.

9. The exercising apparatus of claim 8 in which said first outer handle and said second outer handle include a cushioning material for protecting said hands.

10. An exercising apparatus for exercising the hands and forearms comprising:

an outer frame having spaced left and right outer gripping members and a pair of spaced elongate members extending between said outer gripping members, one of said elongate members having a first length and the other of said elongate members having a second length greater than said first length such that when said outer gripping members are each positioned in a hand, said outer frame retains the hands and arms in a proper exercise position during use of said apparatus, an inner frame having left and right inner gripping members and a pair of spaced rigid connecting members joining said left inner gripping member to said right gripping member, said connecting members being slidably mounted to said elongate members to couple said inner frame to said outer frame with said left and right inner gripping members positioned opposite said left and right outer gripping members, respectively, said inner frame being movable relative to said outer frame in a first direction to move said left inner gripping member toward said left outer gripping member while moving said right inner gripping member away from said right outer gripping member, and in a second direction opposite said first direction to move said right inner gripping member toward said right outer gripping member while moving said left inner gripping member away from said left outer gripping member, said inner frame being movable by a pair of hands engaging the left inner and outer gripping members and the right inner and outer gripping members, respectively, with one hand moving the engaged inner gripping member toward the associated outer gripping member while the other hand resists movement of the engaged inner gripping member relative to the associated outer gripping member.

11. The exercising apparatus of claim 10 in which said inner gripping members are rotatable relative to said connecting members.

12. The exercising apparatus of claim 10 in which said outer gripping members include a padding material for cushioning the hands.

13. The exercising apparatus of claim 10 in which said connecting members each have a channel formed therein, said channel being shaped to receive one of said elongate members.

* * * * *